US006317952B1

(12) United States Patent
Vogt

(10) Patent No.: US 6,317,952 B1
(45) Date of Patent: Nov. 20, 2001

(54) HOLE REPAIR DEVICE

(76) Inventor: David John Vogt, 4/73 Windmill Street, Millers Point New South Wales 2000 (AU)

( * ) Notice: Subject to any disclaimer, the term of this patent is extended or adjusted under 35 U.S.C. 154(b) by 0 days.

(21) Appl. No.: 09/367,995

(22) PCT Filed: Feb. 24, 1997

(86) PCT No.: PCT/AU97/00107

§ 371 Date: Sep. 14, 1999

§ 102(e) Date: Sep. 14, 1999

(87) PCT Pub. No.: WO98/38402

PCT Pub. Date: Sep. 3, 1998

(51) Int. Cl.[7] ..... B23P 19/04; E02D 37/00

(52) U.S. Cl. ..... 29/402.09; 29/402.01; 29/402.18; 52/514; 52/27

(58) Field of Search ..... 29/402.09, 402.14, 29/402.01, 402.02, 402.18; 52/514, 27; 114/227

(56) References Cited

U.S. PATENT DOCUMENTS 2,638,774 * 5/1953 Wieman ..... 52/514
3,583,122 * 6/1971 Biegajski ..... 52/514
3,690,084 * 9/1972 Leblanc ..... 52/514
3,834,107 * 9/1974 Standing ..... 52/514
4,075,809 * 2/1978 Sirkin ..... 52/514
4,100,712 * 7/1978 Hyman ..... 52/514
4,354,332 * 10/1982 Lentz ..... 52/514
4,370,842 * 2/1983 Martin et al. ..... 52/514
5,033,949 * 7/1991 Jewett ..... 52/514
5,058,519 * 10/1991 Collins ..... 29/402.09

* cited by examiner

*Primary Examiner*—S. Thomas Hughes
*Assistant Examiner*—Marc Jimenez
(74) *Attorney, Agent, or Firm*—Ladas and Parry

(57) ABSTRACT

The present invention relates to a device to assist in filling a hole in a sheet or plate of any material, with a filler compatible with the material, the device comprising a flexible plate adapted to be inserted through the hole in the sheet or plate; a detachable attachment member adapted to extend generally perpendicularly from a surface of the flexible plate and including a connection to locate at least one locking member thereto; the locking member being detachably attachable to the attachment member so as to apply a tensile load on the attachment member thereby causing the flexible plate to bear on and be held adjacent to the hole.

20 Claims, 3 Drawing Sheets

HOLE REPAIR DEVICE

TECHNICAL FIELD

The present invention relates to the sealing and/or repair of holes in a sheet or plate of any materials. In particular it describes a device, and a process for the use of that device in the sealing and/or repair of holes in sheets or plates of any material.

BACKGROUND ART

In the past, the repair of large holes in structures, such as holes in walls, was a time consuming and difficult undertaking. Once complete, the results of the so-called hole repair were often viewed as unsatisfactory. Some of the more common problems associated with the previously available methods of hole repair included sagging and, in particular, difficulties in obtaining a substantially flush finish with the surface of the structure in which the hole had occurred.

Previous devices used to aid in the repair of holes in structures included the use of wire mesh, or its equivalent, as a backing material. However, wire mesh suffered from the disadvantage that it was very difficult to attach the mesh to the rear surface of the structure surrounding the hole. Also, when the mesh was attached to the front surface of the structure surrounding the hole, and suitable filling materials applied, the repaired hole suffered from a unsightly bulge compared to the surrounding structure. Furthermore, when the filling material was applied to the mesh, the mesh was often lacking in material strength and consequently was subject to sagging.

The present invention provides a device where holes in sheets or plates of any material may be filled without encountering the problems of sagging, whilst also obtaining a finish flush with the surface of the structure undergoing repair.

DISCLOSURE OF THE INVENTION

According to a first embodiment of the invention there is provided a device to assist in filling a hole in a sheet or plate of any material, with a filler compatible with said material, said device comprising:

- a flexible plate adapted to be inserted through said hole in a sheet or plate;
- a detachable, attachment member adapted to extend generally perpendicularly from a surface of said flexible plate and including means to locate at least one locking member thereto;
- said locking member being detachably attachable to said attachment member so as to apply a tensile load on said attachment member thereby causing said flexible plate to bear on and be held adjacent to said hole.

Typically the flexible plate may be adapted to be inserted through a hole in a sheet or plate of any material by a hinged mechanism within the flexible plate.

Preferably the flexible plate may be adapted to be inserted through a hole in a sheet or plate of any material by a concertina mechanism within the flexible plate.

More preferably the flexible plate may be adapted to be inserted through a hole in a sheet or plate of any material by virtue of the flexible plate consisting of a flexible membrane.

Typically the flexible plate consists of a shearable material, allowing the flexible plate to be custom sized to the hole to be repaired.

Typically, the flexible plate is formed of any suitable material, such as timber, fibreglass, rubber, cardboard, or a plastic such as polypropylene.

Typically the flexible plate includes at least one reinforcing rib.

Typically the flexible plate and/or reinforcing rib(s) is comprised of a series of apertures to allow the filler to pass through the flexible plate and/or reinforcing rib(s), thus providing maximal adhesion and permitting the flexible plate to itself become an integral component of the filled surface.

Typically the flexible plate and/or reinforcing rib(s) may have adhesive applied to at least one surface of the flexible plate and/or reinforcing rib(s) to facilitate the attachment of the flexible plate and/or reinforcing rib(s) to the sheet or plate to be repaired, whilst also facilitating the adhesion of the suitable filler material to the flexible plate and/or reinforcing rib(s).

Typically the attachment member is attached to the surface of the flexible plate by a screw mechanism.

More typically the attachment member is attached to surface of the flexible plate by a snap-release mechanism.

Even more typically the attachment member is attached to surface of the flexible plate by a flange release mechanism.

Typically the locking member is attached to attachment member in such a way as to accommodate holes of different thickness within the sheet or plate of any material.

Typically the locking member is attached to attachment member by a screw mechanism.

More typically the locking member is attached to attachment member by a clamping mechanism.

Even more typically the locking member is attached to attachment member by a series of graduated notches into which the attachment member locks in.

According to a second embodiment of the invention there is provided a method for filling a hole in a sheet or plate of any material with a filler compatible with said material, using the device in accordance with the first embodiment of the invention comprising:

- attaching attachment member to the flexible plate;
- inserting the flexible plate and attached attachment member through the hole in the sheet or plate of any material;
- communicating the locking member with the attachment member and surface of the sheet or plate of any material, so as to apply a tensile load on the attachment member thereby securing the flexible plate to rear face of the sheet or plate to substantially cover the hole;
- partially filling hole with a filler compatible with the material of the sheet or plate;
- allowing the filler to at least partially set;
- detaching the attachment member together with the locking member;
- filling remainder of hole with the suitable filling material.
- Typically, the fillers used in the invention may be organic such as polyester resisn or inorganic such as plaster of paris.

Typically, the fillers used in the present invention include: carbonates, fluorides, hydroxides, metals, oxides, silicates, sulfates, sulfides, celluloses, fatty acids, lignins, polyalkenes, polyamides, polyaromatics, polyesters, proteins, or a combination thereof.

BRIEF DESCRIPTION OF THE DRAWINGS

Preferred forms of the present invention will now be described by way of example with reference to the accompanying drawings, wherein.

BEST MODE OR MODES OF CARRYING OUT THE INVENTION

Figure 1:
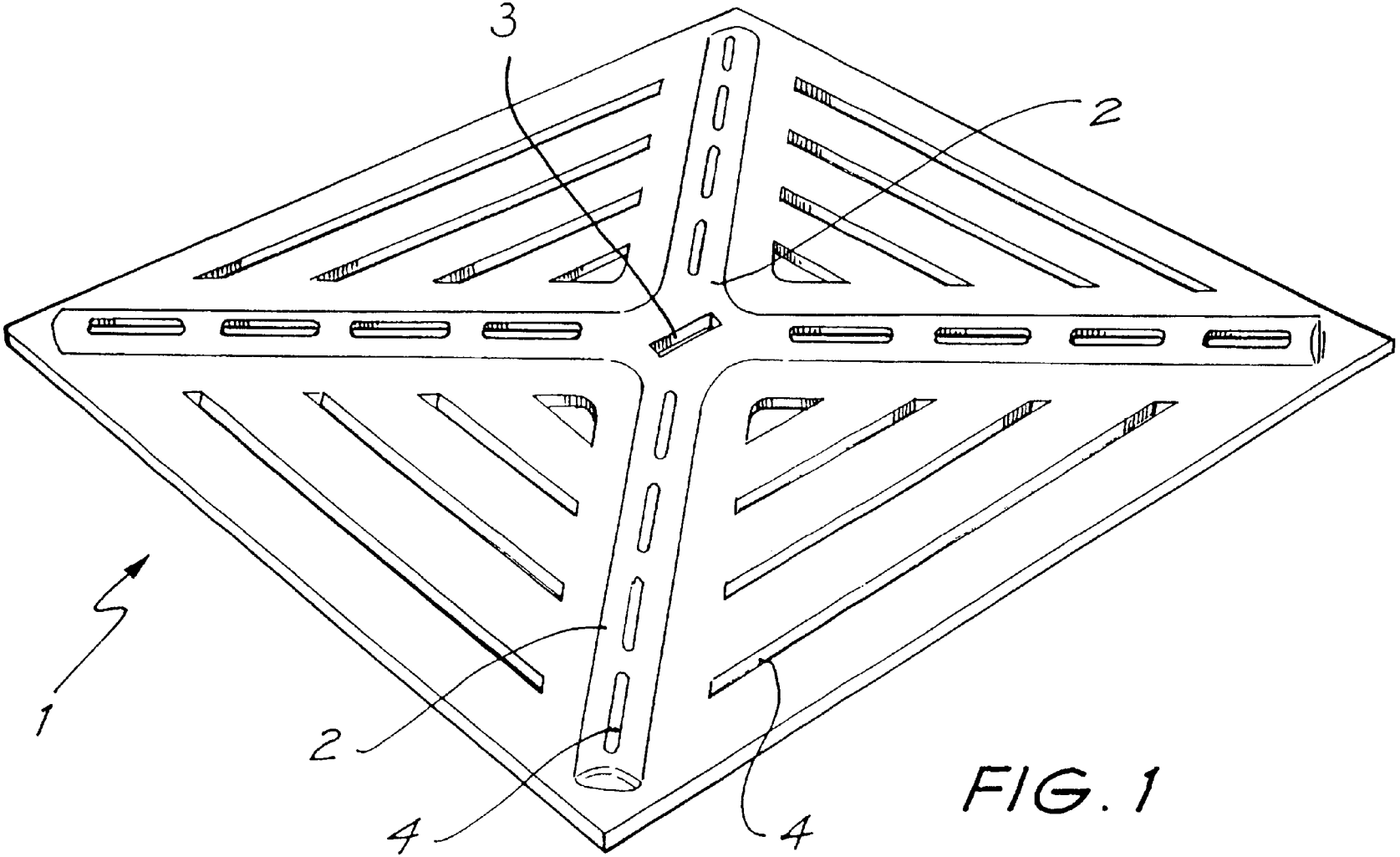
FIG. 1 is a perspective view of the flexible plate of the present invention.
Figure 3:
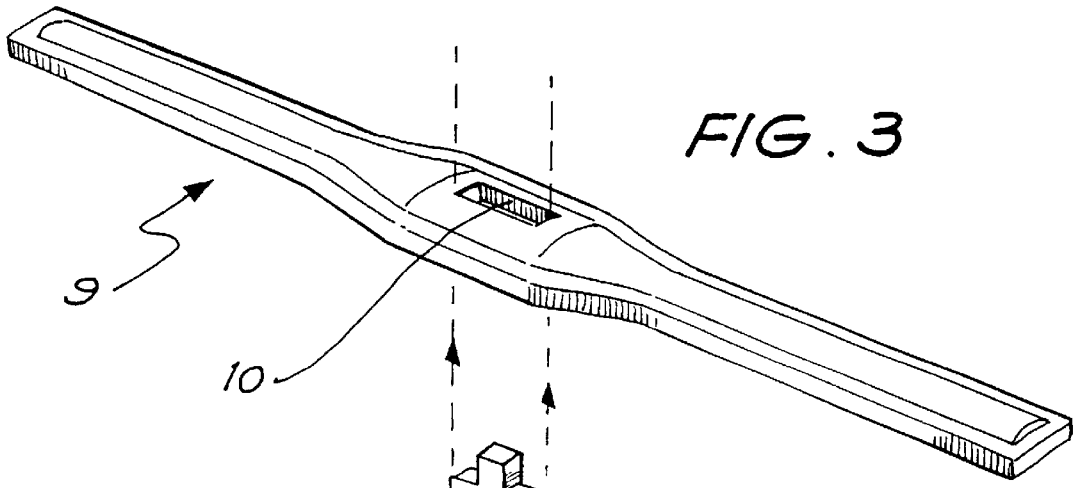
FIG. 3 is a perspective view of the locking member of the present invention.
Figure 2:
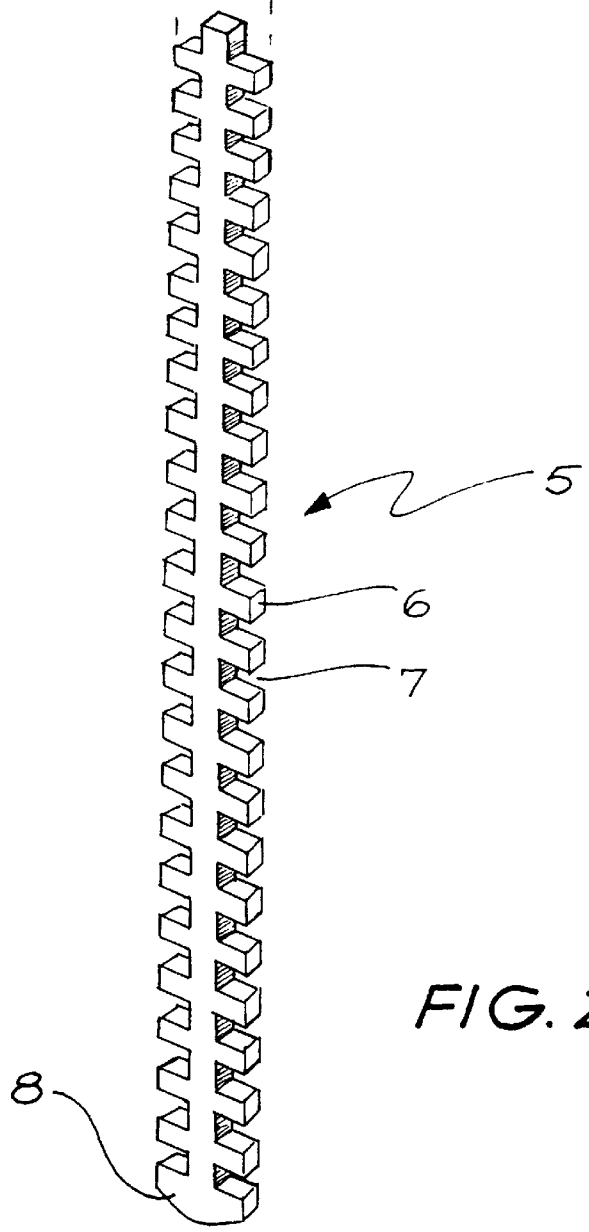
FIG. 2 is a perspective view of the attachment member of the present invention.

To utilise the hole repair mechanism of the present invention, the attachment member (5) is attached to the flexible plate (1) by means of an interlocking flange (8) located at one end of the attachment member (5), inserted through a slot (3) in the flexible plate (1), and adapted in such a way as to securely attach the attachment member (5) to the flexible plate (1).

The flexible plate (1), with attached attachment member (5) is then adapted to be inserted through a hole (11) in the sheet or plate (12 ) of any material to be repaired. The insertion of the flexible plate (1), with attached attachment member (5) is facilitated by the flexible nature of the flexible plate (1). This flexible nature may be achieved by virtue of the flexible plate (1) consisting of a plasticised fabric or a similar deformable material such as polypropylene.

Once the flexible plate (1), with attached attachment member (5), has been inserted through the hole in the sheet or plate of any material to be repaired, a locking member (9) is attached to the attachment member (5). The attachment of the locking member (9) to the attachment member (5) may be achieved by virtue of a slot (10) within the locking member (5) which communicates with a plurality of notches (7) and ridges (6) along the length of the attachment member (5). The locking member (9), via the slot (10) within the locking member (9), fits over the attachment member (5) and locks into one of a plurality of ridges (6) along the attachment member (5). The locking member (9) is locked into one of these ridges (6) along the attachment member (5) in such a way as to exert a tensile load upon the attachment member (5) and thereby causing the flexible plate (1) to bear on and be held adjacent to the hole to be repaired.

Furthermore, the position of the locking member (9) in relation to the attachment member (5) is determined as a function of the thickness of the sheet or plate of any material surrounding the hole to be repaired. The distance between the locking member (9) and the flexible plate (1) can be varied by simply moving the locking member (9) up or down the length of the attachment member (5), and by locking the slot (10) within the locking member (9) into a different notch (7) within the attachment member (5), thus accommodating sheets or plates of any material of different thickness. Also, for holes of varying lengths and widths, the flexible plate (1) consists of such a material which allows it to be cut to a shape to fit the particular dimensions of the hole in question.

In order to prevent the flexible plate (1) from falling in on itself, the flexible plate (1) also comprises at least one reinforcing rib (2) which acts to strengthen both the flexible plate (1) and the subsequent filled and repaired hole. Furthermore, both the flexible plate (1) and the reinforcing rib(s) (2) attached to the flexible plate consist of a series of apertures (4) which allow a suitable filler material to pass through the flexible plate (1) and/or reinforcing rib(s) (2), thus providing maximal adhesion and permitting the flexible plate (1) to itself become an integral component of the filled surface, and therefore increasing the strength of the repaired hole.

Depending on the size of the hole to be repaired, and consequently, the size of the flexible plate (1) required to substantially cover the hole, more than one locking member (9) may be required in order to bear the necessary load on the attachment member (5) to ensure that the flexible plate (1) sufficiently abuts the rear surface of the sheet or plate of any material in which the hole is being filled.

The invention will now be described in greater detail by reference to specific examples, which should not by construed as limiting on the scope thereof.

EXAMPLE 1

The following example describes the repair of a hole in a wall or ceiling made of any material. Firstly, the flexible plate is placed against the hole, and the dimensions of the hole are traced upon the flexible plate. The plate is then cut to size, so as to fully cover the hole, whilst still having an effective overhang on all sides, thus ensuring it will remain in place when pressure is applied to the attachment member. The attachment member is attached to the custom sized flexible plate. The flexible plate with the attachment member in place is then inserted through the hole in the wall or ceiling. Such an insertion relies on the deformable nature of the flexible plate.

Figure 4:
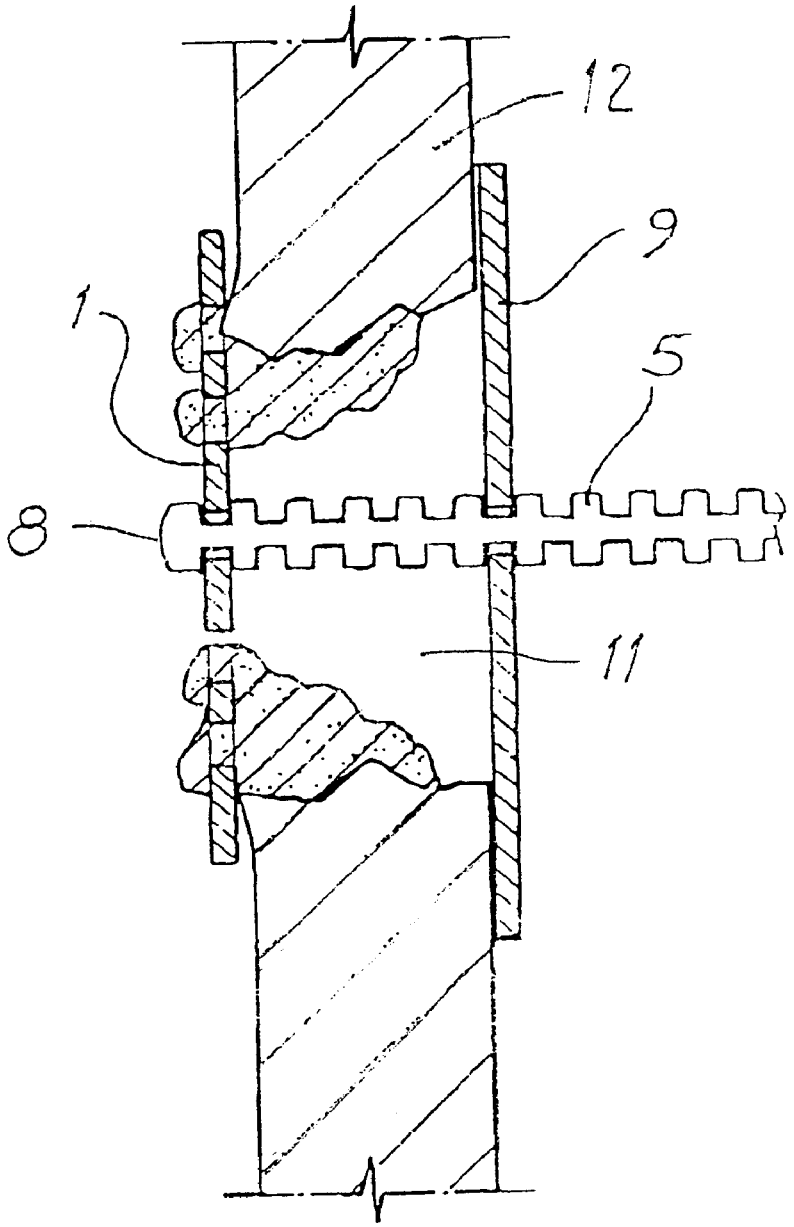
FIG. 4 is a sectional view showing the mounted state of the flexible plate.

The operator then positions the flexible plate to cover the hole, leaving an approximately even overhang on all sides of the hole. By exerting a force on the flexible plate and the attached attachment member, the operator ensures that the flexible plate abuts firmly against the rear surface of the wall or ceiling undergoing repair. The locking member is then attached to the attachment member, thereby causing the flexible plate to bear on and be held adjacent to the hole in the wall or ceiling as shown in FIG. 4.

Once the device is attached to the wall or ceiling, a filler material, such as a plaster or gypsum based filler common to the building trade, is then trowelled around the edges of the hole, and allowed to at least partially set. The locking member is then disengaged and removed, and the attachment member is also disengaged and removed, or simply cut off. The appropriate filler is then applied to the remainder of the hole, and the repair continued to produce a flush and finished surface.

EXAMPLE 2

The following example describes the repair of a hole in a sheet or panel of a motor vehicle or aircraft. The mechanics of the repair process involving the hole repair device of the present invention are in accordance with the method described in Example 1. In this example, the filler material used to repair the hole in a sheet or panel of a motor vehicle or aircraft would be one common to these trades, and would be preferably one which is reinforced with suitable fibres.

EXAMPLE 3

The following example describes the repair of a hole in a sheet or panel of a marine craft. The mechanics of the repair process involving the hole repair device of the present invention are in accordance with the method described in Example 1 and shown in Figure. In this example, the filler material used to repair the hole in the sheet or panel of a marine craft would be one common to this trade, and would be preferably one which is rich in plastic resin, such as epoxy resin.

Furthermore, when repairing marine craft, for example, repairing a hole in a bouyancy tank, the hole repair device of the present invention provides the advantage that it negates the need to remove and/or cut-out sections of the upper deck in order to access and repair the hole.

What is claimed is:

1. A device to assist in filling a hole in a sheet, or plate or panel of any material, with a filler compatible with said material, said device comprising:

a flexible plate adapted to be inserted through said hole in said sheet, or plate or panel from a front surface to a back surface of said sheet, plate or panel;

a detachable, attachment member attachable to said flexible plate to extend generally perpendicularly from a surface of said flexible plate, a locking member, and a connection between said attachment member and said locking member to secure said locking member thereto;

said locking member being detachably attachable to said attachment member by said connection so as to apply a tensile load on said attachment member thereby causing said flexible plate to bear on and be held against a back surface of said sheet, or plate or panel adjacent to said hole, said flexible plate being made of a unitary material to provide a uniform flexibility, said material being shearable to allow the flexible plate to be sized to the hole to be repaired, wherein said flexible plate has reinforcement ribs extending in crossing relation thereon, said plate being provided with a series of apertures extending between said ribs for passage of filler material therethrough to bond the flexible plate to said sheet, or plate or panel.

2. The device of claim 1, wherein the flexible plate includes a hinged mechanism to enable insertion of said flexible plate through said hole.

3. The device of claim 1, wherein the flexible plate includes a concertina mechanism to enable insertion of said flexible plate through said hole.

4. The device of claim 1, wherein the flexible plate is formed of a flexible, deformable membrane to enable insertion of said flexible plate through said hole.

5. The device of claim 1, wherein the flexible plate is formed of a plastic material.

6. The device of claim 1, wherein the flexible plate is formed of polypropylene.

7. The device of claim 1, wherein the flexible plate has a series of apertures to allow a filler compatible with said flexible plate to pass through the flexible plate.

8. The device of claim 1, wherein the flexible plate has adhesive applied to at least one surface thereof.

9. The device of claim 1, wherein the attachment member is attached to surface of the flexible plate by a snap-release mechanism.

10. The device of claim 1, wherein the attachment member is attached to surface of the flexible plate by a flange release mechanism.

11. The device of claim 1, wherein the connection between the attachment member and the locking member comprises a series of graduated notches into which the attachment member locks in.

12. The device of claim 1, wherein the connection of the locking member to the attachment member is variably adapted to attach to said attachment member to enable the repair of holes of different depths within said sheet, plate or panel.

13. A method for filling a hole in a sheet, plate or panel of a material with a filler compatible with said material, using the device according to claim 1 comprising:

attaching said attachment member to said flexible plate;

inserting the flexible plate and attached attachment member through said hole in said sheet, plate or panel;

communicating at least one locking member with the attachment member and a surface of the sheet, plate or panel, so as to apply a tensile load on the attachment member thereby securing the flexible plate to the back surface of the sheet, plate or panel to substantially cover the hole;

partially filling hole with a filler compatible with the material of the sheet, plate or panel to be repaired;

allowing the filler to at least partially set and secure the flexible plate to the sheet, plate or panel;

detaching the attachment member together with the locking member from the flexible plate, and filling a remainder of hole with the filling material.

14. The method of claim 13, wherein the suitable filler consists of an inorganic material.

15. The method of claim 14, wherein the inorganic material includes plaster of paris.

16. The method of claim 13, wherein the suitable filler consists of an organic material.

17. The method of claim 16, wherein the organic material includes polyester resin.

18. A device as claimed in claim 1, wherein said connection between the attachment member and the locking member provides axial adjustability of the locking member on the attachment member with rotational fixation therebetween.

19. A device as claimed in claim 1, wherein said connection between the attachment member and the locking member includes notches in one of said members and a slot in the other of said members, said slot being engagable with one of said notches to axially and rotationally secure said members together in bearing engagement with a front surface of said sheet, plate or panel while applying said tensile load to said flexible plate to cause said flexible plate to bear against the back surface of the sheet, plate or panel.

20. A device as claimed in claim 19, wherein said attachment member is axially and rotationally secured to said flexible plate.

* * * * *